US008615087B2

(12) United States Patent
DiCrescenzo et al.

(10) Patent No.: US 8,615,087 B2
(45) Date of Patent: Dec. 24, 2013

(54) OCDM-BASED PHOTONIC ENCRYPTION SYSTEM WITH PROVABLE SECURITY

(75) Inventors: Giovanni DiCrescenzo, Madison, NJ (US); Shahab Etemad, Warren, NJ (US); Ronald Menendez, Chatham, NJ (US)

(73) Assignee: Telcordia Technologies, Inc., Piscataway, NJ (US)

( * ) Notice: Subject to any disclaimer, the term of this patent is extended or adjusted under 35 U.S.C. 154(b) by 409 days.

(21) Appl. No.: 12/391,098

(22) Filed: Feb. 23, 2009

(65) Prior Publication Data

US 2010/0232608 A1 Sep. 16, 2010

Related U.S. Application Data

(60) Provisional application No. 61/066,515, filed on Feb. 21, 2008.

(51) Int. Cl.
*H04K 1/00* (2006.01)

(52) U.S. Cl.
USPC ..... 380/287

(58) Field of Classification Search
USPC ..... 380/287
See application file for complete search history.

(56) References Cited

U.S. PATENT DOCUMENTS 7,149,199 B2 * 12/2006 Sung et al. ..... 370/330
7,333,611 B1 2/2008 Yuen et al.
2004/0218606 A1 * 11/2004 Leatherbury et al. ..... 370/395.5
2006/0171722 A1 * 8/2006 Toliver ..... 398/188
2006/0239334 A1 * 10/2006 Kwon et al. ..... 375/132
2007/0087756 A1 4/2007 Hoffberg

OTHER PUBLICATIONS

International Search Report dated Nov. 12, 2009.
Menendez, R.C. et al. Network Applications of Cascaded Passive Code Translantion for WDM-Compatible Spectrally Phase-Encoded Optical CDMA. Journal of Lightwave Technology, Oct. 2005, pp. 3219-3231, vol. 23, No. 10.
Goldberg, Sharon, et al. Towards a Cryptanalysis of Spectral-Phase Encoded Optical CDMA with Phase-Scrambling. OpticalFiber Communication Conference and Exposition and the National Fiber Optic Engineers Conference, OSA Technical Digest Series, Optical Society of America, Mar. 2007.
S. Etemad et. al., "OCDM-Based Photonic Layer "Security" Scalable to 100 Gb/s for Existing WDM Networks", invited Journal of Optical Networking vol. 6, issue 7, pp. 948-976, Jul. 2007.
R. Menendez et al., "Network Applications of Cascaded Passive Code Translation for WDM-Compatible Spectrally Phase Encoded Optical CDMA," IEEE J. of Lightwave Technology, vol. 23, pp. 3219-3231, 2005.
P.Toliver et. al., "40 Gb/s OCDM-based Signal Transmission over 400km Using Integrated Micro-Ring Resonator-based Spectral Phase Encoding and Quaternary Code Scrambling for Enhanced Data Confidentiality", ECOC2007, Post Deadline Paper 33.
S. Goldberg, et. al. "Towards a Cryptanalysis of Spectral-Phase Encoded OCDMA with Phase-Scrambling", OFC 2007, OTH-J7.
B. Schneier, "Applied Cryptography", John Wiley and Sons, 1996.

* cited by examiner

*Primary Examiner* — Teshome Hailu
(74) *Attorney, Agent, or Firm* — Philip J. Feig

(57) ABSTRACT

In an OCDM-based photonic encryption system by applying random noise on unused channels and varying the inter-code phases on realistic framing repetition, an OCDM-based encryption system with provable security guarantees results.

6 Claims, 2 Drawing Sheets

OCDM-BASED PHOTONIC ENCRYPTION SYSTEM WITH PROVABLE SECURITY

CROSS-REFERENCE TO RELATED APPLICATIONS

This application claims the benefit of the filing date of U.S. Provisional Patent Application No. 61/066,515, filed Feb. 21, 2008, the disclosure of which is hereby incorporated herein by reference.

GOVERNMENT LICENSE RIGHTS

This invention is based upon work supported in part by U.S. Government DARPA O-CDMA project under contract MDA972-03-C-0078. The U.S. Government has certain rights in the invention.

FIELD OF THE INVENTION

The present invention relates generally to the provision of security (or, more specifically, confidentiality) for ultra high bandwidth optical communications over transparent wavelength-division multiplexed (WDM) networks. Specifically, random noise on unused channels and varying the inter-code phases on realistic framing repetition are used to obtain an encryption scheme for adding confidentiality to communication transmitted over spectral-phase encoded optical code division multiplexing (OCDM) networks and for which it is possible to prove desirable security guarantees.

BACKGROUND OF THE INVENTION

The problem of keeping data transmitted from a sender to a receiver confidential against an adversary acting as an eavesdropper can be solved using encryption schemes. In a nutshell, a (symmetric) encryption scheme is a pair of algorithms: an encryption algorithm, run by the sender, that, on input a secret key and clear data, returns encrypted data; and a decryption algorithm, run by the receiver, that, on input a secret key and encrypted data, returns clear data. (See FIG. 1, described below, depicting an associated model.) The basic correctness requirement is that if the secret keys used by sender and receiver are the same, the clear data recovered by the receiver is precisely the one that was sent by the sender. The basic security (or, more precisely, confidentiality) requirement is, informally speaking, that if the secret key used by sender and receiver is random and unknown to the adversary, then the adversary obtains no information about the clear data from the encrypted data. Note that the adversary is given full access to the encryption and decryption algorithm (but no access to the associated secret key). Several stronger variations of this requirement are actually studied, where the adversary can mount more elaborated attacks, such as "chosen-message", and "chosen-ciphertext" attacks. Classic encryption schemes, developed until the $20^{th}$ century, where based on basic principles of "confusion" and "diffusion". The first provable confidential scheme, the One-Time Pad, invented by Vernam in the early 1900's, and analyzed by Shannon in its pioneering works in the mid 1900's, was the first provable secure encryption scheme, but is today considered inefficient (as a stand-alone scheme) as it requires a number of random bits at least equal to the number of data bits. Modern encryption schemes use short (e.g., 128-bit) random keys, and are based on block ciphers (such as AES), composed using appropriate modes of operations (such as the CBC mode). Such schemes have limited provable confidentiality properties but are widely believed to be secure and are thus employed in all applications.

Communication over OCDM-based networks allows a receiver to obtain data from multiple senders or from a single sender using multiple parallel data streams. A public encoding algorithm is used by the sender to simultaneously process these data streams, and a public decoding algorithm is used by the receiver to decode any single one of the sender's data streams. The optical fiber physical conditions induce inter-code phase shifts on the data encoded by the sender, but such shifts are not changing the receiver's ability to obtain the sender's data. (See FIG. 2, described below, depicting an associated model.) When no encryption procedure is performed, just as with conventional networks, an adversary acting as an eavesdropper can use the same receiver's algorithm to decode data and thus violate data confidentiality.

Prior techniques for providing security for ultra high bandwidth optical communications over WDM networks includes the use of conventional electronic digital encryption which is not readily scalable to very high data rates and is not robust to archival attack and spoofing. Another prior technique is the use of Essex's phase scrambling of a single modulation broadened laser line which is not robust to known plain text (KPT) attack.

Optical code division multiplexing (OCDM)-based security by obscurity has been promoted as a scalable "security" solution for spectral-phase encoded OCDM systems operating at aggregate data rates of 100 Gb/s and beyond that can be realized with available technology through inverse multiplexing of 10 Gb/s tributaries, each carried on a OCDM code. Such a scheme is described in S. Etemad et. al., "OCDM-Based Photonic Layer "Security" Scalable to 100 Gb/s for Existing WDM Networks", invited paper in the Journal of Optical Networking volume 6, issue 7, pages 948-976, July 2007. The approach is based on the early proposal that scrambling of the phase of the combined aggregate of OCDM codes in use increases the search space beyond the reach of an exhaustive search attack. See, R. Menendez et al., "Network Applications of Cascaded Passive Code Translation for WDM-Compatible Spectrally Phase Encoded Optical CDMA," IEEE J. of Lightwave Technology, Vol. 23, pp. 3219-3231, 2005. The earlier solution has been demonstrated in the laboratory for an aggregate 40 Gb/s over 400 km transmission distance. See, P. Toliver et al., "40 Gb/s OCDM-based Signal Transmission over 400 km Using Integrated Micro-Ring Resonator-based Spectral Phase Encoding and Quaternary Code Scrambling for Enhanced Data Confidentiality", ECOC2007, Post Deadline Paper 33. However, robustness against known plain text (KPT) attacks was questioned by showing with some idealized assumptions that the search space is dramatically reduced from $p^n$ to $p^{(n-m)}$, where n is the number of phase-locked wavelengths and also the maximum number codes available, (n-m) is the actual number of codes in use and p is the number phase states supported by the scrambler. See, S. Goldberg, et. al. "Towards a Cryptanalysis of Spectral-Phase Encoded OCDMA with Phase-Scrambling", OFC 2007, OTH-J7.

SUMMARY OF THE INVENTION

The present invention overcomes the limitations of the prior art by applying two coupled realistic and practical means ensuring robustness of OCDM-based security by obscurity against KPT attack, as defined for electronic encryption in the book by B. Schneier, entitled "Applied Cryptography", John Wiley and Sons, 1996. First is introduction of the concept of "entropy" infusion by using random noise on some of the non-data carrying codes whose exact code assignments are shared but whose contents are not shared with or relevant to the receiving end. At the expense of reducing spectral efficiency, using other codes for random frameless noise decreases the ability to decipher the phase scrambler key. However, a compromise can be achieved in order not to reduce the spectral efficiency below a useful transmission rate by introducing a parallel process: changing the inter-code phase at a rate comparable to the KPT rate.

The invention will be more clearly understood when the following description is read in conjunction with the accompanying drawings.

DETAILED DESCRIPTION OF THE INVENTION

Figure 2:
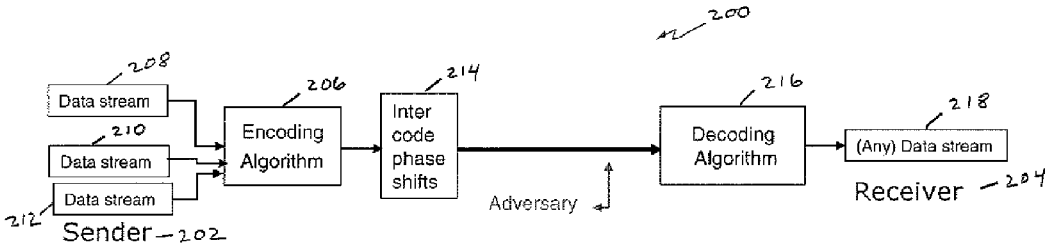
FIG. 2 is a schematic block diagram depicting photonic (unencrypted) communication between a sender and a receiver.

As modern techniques guaranteeing data confidentiality are today regularly deployed in various real-life applications, an immediate approach for data confidentiality over OCDM-based networks would be to directly deploy these encryption techniques on top of the OCDM-based communication model, as shown in FIG. 2. However, this would significantly slow down the remarkable OCDM-network communication rates to those of conventional networks. In fact, even the fastest commercially available encryption schemes that operate in conventional networks at Gb/s data rates are very expensive. Furthermore, one would need one such system for each data stream. Instead, we use "all-optical techniques" to design and deploy encryption schemes over OCDM-based networks, so to simultaneously obtain (in a single solution) the best of both worlds: the remarkable communication rates enjoyed by OCDM-based networks and the highly satisfactory confidentiality properties enjoyed by encryption schemes over conventional networks.

Figure 3:
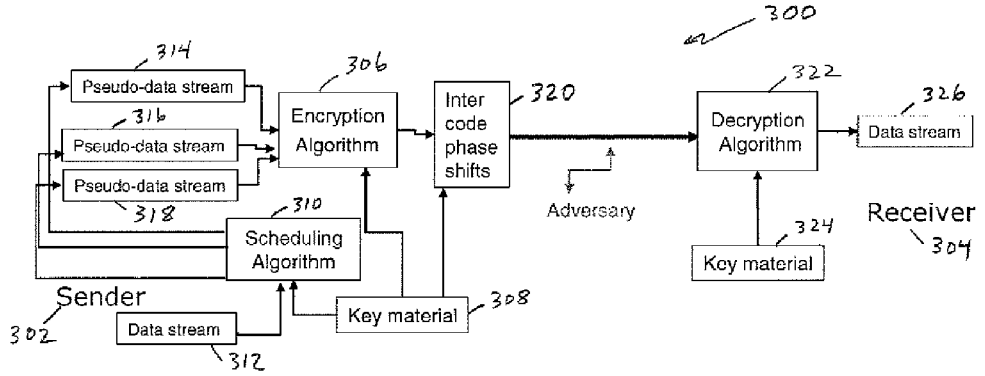
FIG. 3 is a schematic block diagram depicting photonic encrypted communication between a sender and a receiver.

An architecture model that can be used as a starting reference model to achieve this goal is depicted in FIG. 3, described below. Here, note that, in addition to using an encryption algorithm, the sender also uses a scheduling algorithm that combines material from the secret key and from the data stream into multiple parallel pseudo-data streams, which play a role analogue to the multiple data streams in the architecture depicted in FIG. 2.

Figure 4:
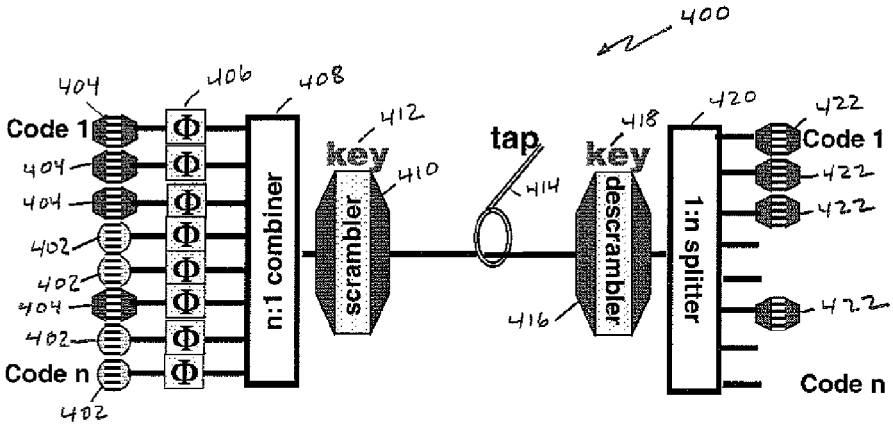
FIG. 4 is a schematic representation of a photonic encryption system with a mixture of data coders and frameless noise coders, phase modulators, scrambler/descrambler key, and an eavesdropper tap.

In practice, the scheduling algorithm is required to be as simple as possible. In this model, the basic correctness requirement is a natural adaptation of the correctness requirement in the model in FIG. 1: if the secret keys used by sender and receiver are the same, the clear data recovered by the receiver is precisely the one that was sent by the sender. Similarly, the confidentiality requirement in this model is also an adaptation of the analogue requirement in the model in FIG. 1. If the secret key used by sender and receiver is random and unknown to the adversary, then the adversary obtains no information about the clear data from the encrypted data. Here, note that the adversary is given full access to the scheduling, encryption and decryption algorithm, but not to the associated secret key. The stronger variations of this requirement, i.e., confidentiality against "chosen-message" and "chosen-ciphertext" attacks, are also directly transported in this model. Furthermore, while the model in FIG. 3 only considers the case of a single data stream from the sender, we note that it can be extended into a model that allows multiple concurrent data streams as well. Finally, note that FIG. 4 depicts a system with a specific realization of the scheduling, encryption and decryption algorithms from the class of methods in FIG. 3.

Figure 1:
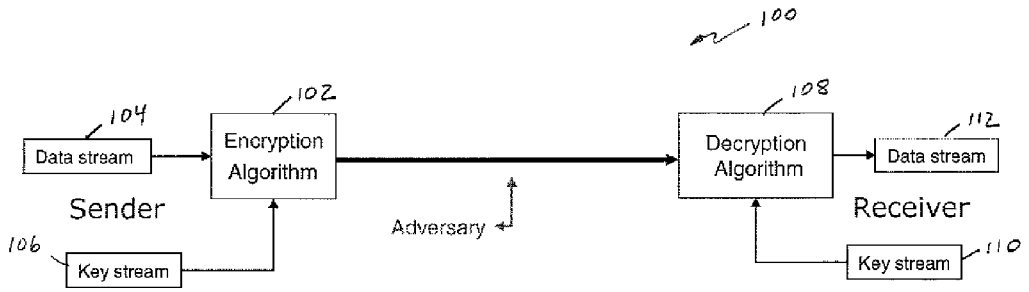
FIG. 1 is a schematic block diagram depicting digital encryption.

FIG. 1 is a block diagram of digital encryption 100 with an encryption algorithm 102, taking as input a data stream 104 and a key stream 106, and returning a ciphertext stream that may be eavesdropped by the adversary, and a decryption algorithm 108, taking as input the ciphertext stream returned by the encryption algorithm and a key stream 110, and returning a data stream 112 that would be equal to the data stream 104 input to the encryption algorithm 102.

FIG. 2 is a block diagram of photonic (unencrypted) communication 200 between a sender 202 and a receiver 204, with an encoding algorithm 206, taking as input multiple data streams 208, 210, and 212, and returning an encoded stream affected by intercode phase shifts 214, and a decoding algorithm 216, taking as input the encoded stream returned by the encoding algorithm, and returning any data stream 218 that would be equal to a data stream input to the encoding algorithm.

FIG. 3 is a block diagram depicting photonic encrypted communication 300 between a sender 302 and a receiver 304, which extends FIG. 2 by replacing the encoding (resp., decoding) algorithm with an encryption (resp., decryption) algorithm 306, taking as additional input a key stream 308, and by adding a scheduling algorithm 310 that, on input a key stream 308 and a data stream 312, returns multiple pseudo-data streams 314, 316, and 318, the encryption algorithm 306 returning an encrypted stream affected by intercode phase shifts 320, and a deccryption algorithm 322, taking as input the encrypted stream returned by the encryption algorithm and a key stream 324, and returning any data stream 326 that would be equal to the input to the scheduling algorithm 310.

Referring to the figures and to FIG. 4 in particular, there is shown a schematic representation of the synchronous OCDM system 400 with n orthogonal codes each used to encode an independent channel where m channels 402 shown in round coders are carrying frameless noise streams and (n-m) channels 404 shown as octagons are carrying real data. After adjusting their intercode optical phase shifts using an inline phase modulator 406, associated with each respective channel, before the coded signals are synchronously combined in the n:1 combiner 408 the aggregate analog signal arrives at a scrambler 410. The scrambler is a coder representing a diagonal matrix that changes the relative phases of the n frequency bins in p phase step settings. In addition, a monomial matrix can be used to permute the frequency assigned to the code elements implemented in the encoders and decoders as is known in the art. Alternatively, the combined effects of the diagonal and monomial matrices can be directly implemented in the codes established in the encoders and decoders. The combined orthogonal matrix identifies the set of codes in use, some of which are carrying data in the general case when not all the codes are in use. In the following, the effect of the diagonal and the diagonal plus monomial matrices are both referred as the scrambler key and for simplicity, in the main embodiment of description here, we will just consider the scrambling via the diagonal matrix. The scrambler key 412 is shared with the receiving end of system and is unknown to the eavesdropper tapping 414 the transmission and because of its short length the key can be updated at will using a secure key distribution method. At the receiving end of the system the descrambler 416 performs the opposite role to the scrambler using key 418 before the 1:n splitter 420 from which the real data goes to decoder channels 422. The noise-carrying channels are ignored and the data-carrying channels 422 are decoded. Note that the relative intercode optical phase shifts are useful in masking the transmission against an eavesdropper but are not necessary for the receiver to successfully decrypt the transmission.

The KPT attack described in Goldberg supra posits an eavesdropper making n simultaneous noise-free analog measurements of the optical electric field at each of the n wavelengths comprising the OCDM signal and further assumes the eavesdropper has complete knowledge of the set of the orthogonal codes in use and the data impressed on each of those codes (KPT) at the precise moment of the field measurement. The eavesdropper is only unaware of the n scrambler phases (assumed binary and fixed) or the (n−1) inter-code phase differences (assuming the inter-code phasing change completely between successive parallel measurements). With repeated measurements, the eavesdropper can accumulate sufficient information about the system to determine the values of the scrambler phase settings, the key. In the following, a threefold approach (1) prevents full knowledge of the plain text in use: phase scrambling based on random diagonal and monomial matrices to preclude the eavesdropper from knowing the set of codes in use, (2) random changes to the inter-code phasing, and, importantly, (3) the addition of random data streams on the unused codes.

The system design is based on the following two techniques that add unshared entropy to the system. First, out of a total of n streams entering into the n:1 combiner 408 in FIG. 4, a set of m random frameless noise streams is imposed (thus effectively leaving n-m streams dedicated to data transmission). Second, dynamic changes to inter-code phasing at a rate d is imposed, where 0<d<=1 in unit of data rate. Both techniques are built on top of previously explored techniques, such as orthogonal coding, and scrambling via a random monomial matrix. As a result of combining all these techniques, the only randomness shared between sender and receiver is the nonzero content of the random (scrambling diagonal times monomial) code matrix. At a high level, our encryption algorithm can be seen as follows: the data stream is split among n-m streams and the frameless noise stream is split among m streams in the system, varying in time among the total of n streams in the system, and all n streams are processed using orthogonal encoding and intercode phase shifts that dynamically change at rate d. Accordingly, the decryption algorithm will crucially use decoding via the matching orthogonal codes to recover the data stream

MAIN EMBODIMENT OF THE INVENTION

In a main embodiment of this invention, we define an optical (symmetric) encryption scheme as a triple (Schedule, OpEncrypt, OpDecrypt) with the following syntax and properties. Let t denote time, let k denote the (fixed-length) key that is shared by both sender and receiver, and let r(t) denote the (frameless noise) random stream that is used by the sender and not shared with the receiver. The details of how k is shared by sender and receiver are left arbitrary and are up to the encryption scheme's application scenario; we only assume that all bits in k are uniformly and independently distributed. Also, let n denote the number of pseudo-data streams, w denote the number of wavelengths (typically, we set w=n), d denote the update rate of the intercede phase shifts, and m denote the number of pseudo-data streams that will carry random bits. On input a plaintext data stream m(t), the key k, and the random stream r(t), the optical scheduling function Schedule returns n pseudo-data streams $de_0(t), \ldots, de_{n-1}(t)$. On input n time-dependent streams $de_0(t), \ldots, de_{n-1}(t)$, the key k and the random stream r(t), the optical encrypting function OpEncrypt returns a ciphertext signal s(t). On input the optical ciphertext signal s(t) and the key k, the optical decrypting function OpDecrypt returns a stream m'(t), or a special symbol, indicating failure in decoding.

We say that the optical scheme (Schedule, OpEncrypt, OpDecrypt) is correct if for any time t, it holds that with probability 1 the stream m'(t) decrypted by the receiver is equal to the plaintext stream m(t), where stream m'(t) is obtained as in the following steps, associated with the functioning of the optical communication scheme:

1. $(de_o(t), \ldots, de_{n-1}(t), phi_0(t), \ldots, phi_{n-1}(t))$=Schedule (n,w,d,m,k,r(t),m(t))
2. $((c_{i,1}(t), \ldots, c_{i,n}(t)), i=1, \ldots, w)$=OpEncrypt (n,w,d,m, k,r(t),$de_0(t), \ldots, de_{n-1}(t)$)
3. for i=1, . . . , w, let $f_i=c/la_i$
4. $s(t)>\Sigma_{[j=1,\ldots,n]}\Sigma_{[i=1,\ldots w]}\cos(f_i*t+c_{i,j}(t)+phi_j(t)$
5. m'(t)=OpDecrypt(n,w,d,m,k,s(t)), where w is the number of wavelength, $la_i$ is the i-th wavelength used, $f_i$ is the i-th wavelength's frequency, c is the speed of light, $c_{i,1}(t), \ldots, c_{i,n}(t)$ from $\{0,\pi\}$ are the n codewords used, $phi_i(t), \ldots, phi_n(t)$ from $[0, 2\pi]$ are the intercode phase shifts associated to these codewords that are due to laser frequency and temperature fluctuations resulting from the aggregation process of the n data streams into a single optical fiber, and we assume that n<=w. (The above steps can be intuitively described as follows: step 1 consists of generating n pseudo-data streams and n intercode phase shifts from the key, the random stream and the data stream; step 2 consists of the optical function encrypting each of the n pseudo-data streams; steps 3 and 4 consist of the aggregation of the n encrypted pseudo-data streams into a single encrypted signal s(t); and step 5 consists of the receiver's decryption of the data stream from s(t).) Finally, we only need to describe the algorithms Schedule, OpEncrypt, OpDecrypt to complete the description of this scheme.

We first describe how this scheme achieves reliable optical communication; i.e., how it chooses orthogonal codewords to allow encoding and reliable decoding of multiple data streams of elements in {0,1}. One popular choice for an orthogonal matrix is the 2u*2u Hadamard matrix H[2u], defined for all positive integers u>=1, with the following recursion:

1. If u=1 then H[2u](i,j)=−1 if i=2 and j=2 and H[2u](i,j)=+1 otherwise
2. If u>1 then H[2u](i,j)=−H[u](i,j) if i>u and j>u and H[2u](i,j)=H[u](i,j) otherwise As an example, rows of matrix H[2u] can be used as orthogonal codewords in the following way: if the j-th row is used as a codeword to transmit one pseudo-data stream, wavelength i is being sent with phase $(1-h_{i,j})\pi/2$, where $h_{ij}$ denotes the entry in the j-th row and i-th column of the (symmetric) matrix H[2u]. Then this scheme uses the j-th row (resp., (u+j)-th row) of H[2u] as a codeword to transmit the next element from the j-th pseudo-data stream if this element is =0 (resp., is =1).

We now formally specify three optical functions Schedule, OpEncrypt, and OpDecrypt.

Optical Function Schedule.

On input as parameters the number of pseudo-data streams n, the number of wavelengths w (where w=n), shared random key k, random stream r(t) and plaintext data stream m(t), such that n=4q, for some integer q>=1, this function simply splits m(t) equally into pseudo-data streams $de_0(t), \ldots, de_{n/4-1}(t)$ if t is odd or $de_{n/2}(t), \ldots, de_{n/2+n/4-1}(t)$ if t is even and fills each of the remaining pseudo-data streams either with a 0 or with a random bit from the random stream r(t). More precisely, when t is odd (the other case being similar), the function reads n/4 consecutive values $m(t_0), \ldots, r(t_{n/4-1})$ in {0,1} from data stream m(t) and n/2 consecutive values $r(t_0), \ldots, r(t_{n/2-1})$ in {0,1} and $r'(t_0), \ldots, r'(t_{n/2-1})$ in [0,2π] from random stream r(t); then, it sets 1. $(de_0(t), \ldots, de_{n/4-1}(t))=(m(t_0), \ldots, m(t_{n/4-1}))$,
2. $de_j(t)=0$ for j=n/2, . . . , n/2+n/4-1,
3. $(de_{n/4}(t), \ldots, de_{n/2-1}(t)=(r(t_0), \ldots, r(t_{n/4-1}))$,
4. $(de_{n/2+n/4}(t), \ldots, de_{n-1}(t))=(r(t_0), \ldots, r(t_{n/2-1}))$,
5. $(phi_1(t), \ldots, phi_n(t))=(r'(t_0), \ldots, r'(t_{n/2-1}))$.

Here note that when t is even, steps 1 to 4 are executed with the only difference that all indices j of quantities $de_j(t)$ are shifted by n/2 (modulo n), and step 5 is executed by setting $(phi_1(t), \ldots, phi_n(t))=(phi_1(t-1), \ldots, phi_n(t-1))$.

Optical Function Encrypt.

This function takes as input the number of pseudo-data streams n, the number of wavelengths w (where w=n), the parameter m=n/2, the shared random key k, random stream r(t) and pseudo-data streams $de_1(t), \ldots, de_n(t)$, each having symbols from {0,1}. The function updates the random intercede phase shifts at a rate of d=½. Given these inputs, this function returns, for i=1 . . . , w and j=1, . . . , n, the value $c_{i,j}(t)=k_i+_{2\pi}de_{ij}(t)$, where $+_{2\pi}$ denotes sum modulo 2π; $k_i$ is =0 if the i-th key bit is a 0 or π if the i-th key bit is a 1, and $de_{ij}(t)$ is computed as $(1-h_{iq}(t))\ \pi/2$, where $h_{iq}(t)$ is the entry of the Hadamard matrix H[n] in the q-th row and i-th column, q being set as follows: q=j if $de_j(t)=0$ or q=n/2+j (mod n) if $de_j(t)=1$.

Optical Function Decrypt.

This function takes as input as input the number of pseudo-data streams n, the number of wavelengths w (where w=n), the parameter m=n/2, the shared random key k, and the signal stream $$s(t)=\Sigma_{[j=1,\ldots,n]}\Sigma_{[i=1,\ldots,w]}\cos(f_i{}^*t+c_{ij}(t)+phi_j(t)).$$

Given these inputs, this function returns data stream m'(t), computed as follows. First, this function computes $s_1(t), \ldots, s_w(t)$, where, for i=1, . . . , w, $$s_i(t)=\Sigma_{[j=1,\ldots,n]}\cos(c_{ij}(t)+phi_j(t)).$$

Then, the contribution from the key is removed by computing, for i=1, . . . , w, $$s_i(t)^*\cos(k_i)=\Sigma_{[j=1,\ldots,n]}\cos(de_{ij}(t)+phi_j(t)).$$

Finally, the next bit on the j-th pseudo-data stream, for j=1, . . . , n/4 (assuming t is odd for simplicity, the other case being similar), will be =0 (resp., =1) if the quantity $$\Sigma_{[i=1,\ldots,w]}(h_{ij}(t)^*(s_i(t)^*\cos(k_i)))$$

is (significantly) different from 0 (resp., close to 0).

Correctness of Decryption Guarantees.

The correctness of the scheme (Schedule, OpEncrypt, OpDecrypt) follows from the orthogonality of matrix K·H[n], where K is a diagonal matrix with key values $(k_1, \ldots, k_n)$ as diagonal elements and H[n] is the n*n Hadamard matrix defined above, which implies that, for j=1, . . . , n/4, (assuming t is odd for simplicity, the other case being similar), the value $$\Sigma_{[i=1,\ldots,w]}(h_{ij}(t)^*(s_i(t)^*\cos(k_i)))$$

is nonzero if $de_{ij}(t)=1$ or 0 otherwise. In particular, note that this holds regardless of the value of $phi_j(t)$.

Provable Security Quarantees.

When eavesdropping the ciphertext signal s(t), an adversary can apply optical 'beat detection' techniques to recover a per-wavelength decomposition of the ciphertext signal. Formally, an adversary can (deterministically) recover, for any time t, and any i=1, . . . , w, the quantity $$s_i(t)=\Sigma_{[j=1,\ldots,n]}\cos(c_{ij}(t)+phi_j(t)).$$

After applying the mapping {0, π} to {−1, 1}, this equality can be rewritten in matrix notation as $$y=K^*H'^*v,$$

where y is an n-length vector measured via beat-detection, K is an n-by-n random scrambling diagonal (or monomial) matrix, v is an n-length vector containing the inter-code phase shifts, and H' is an n-by-n matrix whose rows are chosen from the Hadamard matrix according to the values of the bits in the n pseudo-data streams (as specified in optical function OpEncrypt). Specifically, the bit at (odd) time t in the j-th pseudo-data stream is either equal to an actual data bit (for j=1, . . . , n/4), or to 0 (for j=n/2+1, . . . , n/2+n/4), or to a random bit from the random stream r(t) for the remaining j values. A first important observation here is that the inter-code phase shifts are assumed to be random, and if certain conditions (which we discuss later) between the parameters d,n,m, hold (as they do in the above description), their sign is random too, and then the above equality implies a group operation between the vector of signs of the inter-code phase shifts and the vector of actual data bits, thus resulting in a perfect randomization of the data bits, in correspondence of the values j=1, . . . , n/4. A second important observation here is that the signs of the inter-code phase shifts that are not used to encrypt actual data bits at a given time t but are used for this purpose at the time t+1 still remain random at time t+1 after being used at time t to encrypt random bits. This follows precisely from the randomness of such bits on the pseudo-data streams, which implies a similar group operation between the vector of signs of the inter-code phase shifts and the vector of random pseudo-data bits.

As a consequence of these observations, the eavesdropper's task is that of solving a linear system with knowns (i.e., the eavesdropped and measured quantities) and unknowns (i.e., all source of entropy in the system, including the random stream, the dynamically changing inter-code phase shifts and the scrambled code matrix). The eavesdropper's goal is that of gradually reducing the amount of entropy in the systems, and thus the number of unknowns, by increasing the measured quantities. If a certain condition holds between parameters m, n, d, the number of unknowns is always greater than the number of knowns in the eavesdropper' linear system by an additive factor due to the full entropy of the scrambling matrix. Examples are shown in FIG. 5, where the "unknown" and "known" lines are depicted versus the number of sampling measurements made by the eavesdropper; it should be noted that the unknown line always starts above the known line, but whether the unknowns line remains above the known lines (thus guaranteeing security within the search space of the codes) crucially depends on the parameter values.

Figure 5:
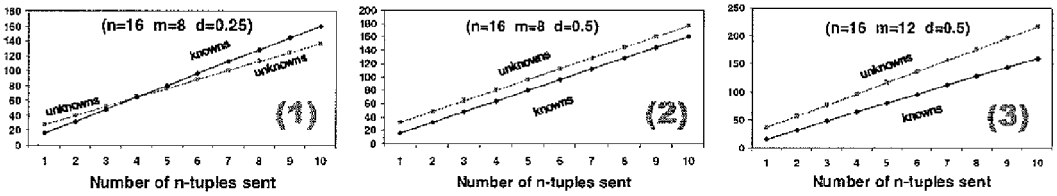
FIG. 5 is a graphical representation of the variations of the number of unknowns and knowns with n=16 measurements of the optical fields at all frequency bins versus bits for different number of noise channels m and inter-channel phase change rate d.

In particular, consider the center panel in FIG. 5, where the number of unknowns grows equally to the number of knowns and thus the number of unknowns is always larger than the number of knowns. This implies that the eavesdropper never learns about the content of the scrambling matrix. Even if the adversary can afford a chosen-message-attack (meaning that it can see encryptions of messages of its choice and later is successful if it learns which among two chosen messages was encrypted by the system), or a chosen-cipher-text (CCT) attack (meaning that it can see decryptions of even adaptively chosen cipher-texts and later is successful if it learns which among two chosen messages was decrypted by the system), the adversary learns no information at all (in an information-theoretic sense) about the content of the scrambling matrix. At best, the adversary can learn all of the m random streams and the dynamically changing inter-code phase shifts, which are random and thus meaningless to the adversary.

This combination of shared randomness (the scrambling matrix) and unshared randomness (the random streams and the dynamically changing inter-code phase shifts) represent an unusual novel design approach, in that no previous encryption algorithm in the electronic or optical domain shared these features. In addition, the size of the key being only on the order of n, makes key distribution, the expensive part of current digital encryption, quite affordable. As usual, increased security comes with a loss of spectral efficiency. The (expected and acceptable) drawback for the security gain is in the amount of global randomness in the system, that increases to 2 random bits and 2 random elements in $[0,2\pi]$ per data bit (however, this can be decreased as mentioned in the alternative embodiments and, most importantly, the amount of shared randomness in the system remains fixed and not dependent on the amount of communicated data), and in the communication rate decrease by a factor of 4.

Alternative Embodiments of the Invention

In a first alternative embodiment of the invention, the random diagonal matrix containing the values for the shared key is further multiplied by a random monomial matrix (i.e., a permutation matrix).

In a second alternative embodiment of the invention, a scheme can be obtained by requiring that there are only two states for the intercode phase shifts, $\theta$ and $\theta+\pi$ which are changed at rate d, as opposed to spanning the entire $[0,2\pi]$ range. For such scheme, the amount of global randomness in the system only increases to 4 random bits per data bit.

In a third alternative embodiment of the invention, a scheme with an arbitrary rate d for update of intercode phase shifts can be achieved by an appropriate generalization of the scheme described in the main embodiment of this invention. This scheme, when combined with the variation in the second embodiment, results in the amount of global randomness in the system increasing to 2+4d random bits per data bit (where again the amount of shared randomness in the system remains fixed and not dependent on the amount of communicated data).

In a fourth alternative embodiment of the invention, the following realistic scenario (e.g. as for ATM networks) is considered where data can be divided into header and payload. The above system is modified by careful scheduling of the 5B header and 48B payload for the ATM format. We analyze the security of the resulting system in this scenario by further assuming that the header is completely known and the payload is completely unknown to the adversary during its attack. This represents a realistic variant of the KPT attack in the case of ATM formats, which are of special interest as they have the shortest data structure of any format in common use. By increasing the amount of plain text data unknown to the attacker, we can even decrease the number of noise carrying channels and the rate of inter-channel phase changes, and we can still increase the crossing point of unknowns and knowns so that transmission of a large number of secure bits is possible. The conclusion here is that even less unshared randomness (up to an order of magnitude) is needed with respect to the more general cases of FIG. 5. In other words it is possible to find a much smaller value for d and still have that the number of unknowns remains greater than the number of knowns in the eavesdropper's linear system by an additive factor due to the full entropy of the scrambling matrix.

In summary, an OCDM-based security solution can be robust to KPT as well as CCT attacks if, in addition to the phase scrambling of the aggregate analogue optical signal, a combination of infusion of entropy using frameless noise streams on unused channels and changing of the inter-channel phases is used. The essence of this robustness lies in the fact that under proper conditions more measurements of the tapped aggregate signal and the knowledge of bits in the plain text used for the attack does not converge and the search space for the setting of the phase scrambler remains very large. These conditions combined with the limited size key and robustness to archival attack makes OCDM-based security an attractive solution scalable to data rates up to 100 Gb/s.

Various aspects of the present disclosure may be embodied as a program, software, or computer instructions embodied in a computer or machine usable or readable medium, which causes the computer or machine to perform the steps of the method when executed on the computer, processor, and/or machine.

The system and method of the present disclosure may be implemented and run on a general-purpose computer or computer system. The computer system may be any type of known or will be known systems and may typically include a processor, memory device, a storage device, input/output devices, internal buses, and/or a communications interface for communicating with other computer systems in conjunction with communication hardware and software, etc. A module may be a component of a device, software, program, or system that implements some "functionality", which can be embodied as software, hardware, firmware, electronic circuitry, or etc.

The terms "computer system" and "computer network" as may be used in the present application may include a variety of combinations of fixed and/or portable computer hardware, software, peripherals, and storage devices. The computer system may include a plurality of individual components that are networked or otherwise linked to perform collaboratively, or may include one or more stand-alone components. The hardware and software components of the computer system of the present application may include and may be included within fixed and portable devices such as desktop, laptop, server, and/or embedded system.

While there has been described and illustrated an OCDM-based photonic encryption system with provable security, it will be apparent to those skilled in the art that modifications and variations are possible without deviating from the principles and broad teachings of the present invention which shall be limited solely by the scope of the claims appended hereto.

What is claimed is:

1. A spectral-phase encoded optical code division multiplexing based photonic encryption system, the system includes a computer processor, comprising:

n independent channels, each adapted for carrying a respective orthogonal code signal where m of the n channels are adapted for carrying a respective frameless noise stream and any among the remaining n-m channels are adapted for carrying real data;

n phase modulators each coupled to a respective one of the n independent channels, each phase modulator applying a dynamically changing inter-code optical phase shift between the n independent channels at a rate d, where $0<d\leqq 1$ in unit of data rate;

an n:1 combiner coupled to the outputs of the n phase modulators to provide a single output signal;

a scrambler for receiving and scrambling the output signal in accordance with a scrambling key for transmitting a scrambled signal, wherein said scrambler comprises a coder representing a diagonal matrix that changes the relative phases of n frequency bins in p phase step settings and a monomial matrix, wherein the monomial matrix permutes the optical frequency assigned to the code elements implemented in a plurality of encoders and decoders;

a descrambler for receiving the scrambled signal and descrambling the scrambled signal in accordance with a descrambling key; and a 1:n splitter for separating the descrambled signal into n-m channels which when decoded correspond to the n-m data carrying channels.

2. The optical code division multiplexing based photonic encryption system as set forth in claim 1, wherein said n-m independent data channels are the inverse multiplexed tributaries of a higher data rate signal.

3. The optical code division multiplexing based photonic encryption system as set forth in claim 1, wherein the scrambling key and the descrambling key can be updated using a secure key distribution method.

4. A method of providing a secure optical code division multiplexing based photonic encryption system comprising the steps of:

providing n streams of signals of which m of the n streams are random frameless noise streams and n-m streams are data;

dynamically changing between the n streams of signals inter-code optical phasing at a rate d, where $0<d\leqq 1$ in unit of data rate;

providing the n steams of signals after dynamically changing the optical inter-code phasing between the n streams of signals to a combiner to provide a single combined signal;

scrambling the resulting combined signal in accordance with a scrambling key representing a diagonal matrix that changes the relative phases of n frequency bins in p phase step settings and a monomial matrix, wherein the monomial matrix permutes the optical frequency assigned to code elements; and wherein the above steps are performed at a source by a computer-processor.

5. The method of providing a secure optical code division multiplexing based photonic encryption system as set forth in claim 4, wherein the values of n, m and d are selected for causing a number of unknowns to exceed a number of knowns of an eavesdropper's linear system.

6. The method of providing a secure optical code division multiplexing based photonic encryption system as set forth in claim 4, further comprising:

at a receiver:

descrambling the n-m streams using matching orthogonal codes.

* * * * *

UNITED STATES PATENT AND TRADEMARK OFFICE

CERTIFICATE OF CORRECTION

PATENT NO. : 8,615,087 B2
APPLICATION NO. : 12/391098
DATED : December 24, 2013
INVENTOR(S) : DiCrescenzo et al.

It is certified that error appears in the above-identified patent and that said Letters Patent is hereby corrected as shown below:

On the Title Page, Item (56), under "OTHER PUBLICATIONS", in Column 2, Line 3, delete "Translantion" and insert -- Translation --, therefor.

On the Title Page, in the Figure, delete " 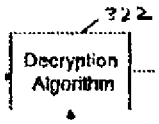

" and insert -- 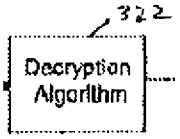

--, therefor.

In the Specification

In Column 4, Line 43, delete "deccryption" and insert -- decryption --, therefor.

In Column 5, Line 57, delete "stream" and insert -- stream. --, therefor.

In Column 7, Line 13, delete ", $r(t_{n/4-1})$" and insert -- , $m(t_{n/4-1})$ --, therefor.

In Column 7, Line 19, delete "$de_{n/2-1}(t)=$" and insert -- $de_{n/2-1}(t))=$ --, therefor.

In Column 8, Line 7, delete "Quarantees." and insert -- Guarantees. --, therefor.

Signed and Sealed this
Twenty-eighth Day of October, 2014

Michelle K. Lee

Michelle K. Lee
*Deputy Director of the United States Patent and Trademark Office*